US005657712A

United States Patent [19]

Romagnoli

[11] Patent Number: 5,657,712

[45] Date of Patent: Aug. 19, 1997

[54] METHOD FOR ATTACHING A TAG TO A TEA BAG

[75] Inventor: Andrea Romagnoli, San Lazzaro di Savena, Italy

[73] Assignee: I.M.A. Industria Macchine Automatiche S.p.A., Bologna, Italy

[21] Appl. No.: 499,192

[22] Filed: Jul. 7, 1995

[30] Foreign Application Priority Data

Jul. 8, 1994 [IT] Italy ..... BO94A0319

[51] Int. Cl.[6] ..... B65B 29/04; D05B 97/00

[52] U.S. Cl. ..... 112/475.08; 112/156; 53/134.2

[58] Field of Search ..... 112/156, 475.08, 112/475.17; 53/134.2, 413; 289/1.2, 1.5, 16, 17; 223/102; 426/77

[56] References Cited

U.S. PATENT DOCUMENTS

| | | | |
|---|---|---|---|
| 2,114,304 | 4/1938 | Ingram | 112/2 |
| 2,149,713 | 3/1939 | Webber | 99/77.1 |
| 2,307,998 | 1/1943 | Eaton | 426/77 |
| 3,566,573 | 3/1971 | Irmscher | 53/134.2 |
| 4,188,894 | 2/1980 | Matsumura | 112/80.02 X |
| 5,135,762 | 8/1992 | Vernon et al. | 426/79 |

FOREIGN PATENT DOCUMENTS 450703 7/1936 United Kingdom .

*Primary Examiner*—Peter Nerbun

*Attorney, Agent, or Firm*—Cushman Darby & Cushman IP Group of Pillsbury Madison & Sutro LLP

[57] ABSTRACT

A method for attaching a tag to a tea bag, where the bag and the tag both have at least one border with reduced thickness, includes the following steps: hooking of a first end or leader of the thread by an eye of a needle and running the thread into the border through to the opposite side of the border so as to make a loop in the thread; widening the loop in such a way as to form an aperture through which the thread can be inserted; inserting the leader into the aperture in the loop and releasing the thread from the needle, the thread being pulled in such a way as to tighten the resulting knot.

10 Claims, 5 Drawing Sheets

METHOD FOR ATTACHING A TAG TO A TEA BAG

BACKGROUND of the INVENTION

The present invention relates to a method for attaching a tag to a tea bag, in particular for attaching a tag to a filter-bag containing tea, chamomile, and similar products, using a thread fixed to the bag at one end and to the tag at the other to form a convenient means of holding the bag itself both during and after infusion.

In the present description, reference will be made to bilobate tea bags but without thereby restricting the application of the disclosure to other kinds of tea bags.

Bilobate tea bags, which are the most common type of single-dose tea bags, are formed of a sheet of filter paper from a continuous roll, folded and sealed longitudinally to form a tube; while the tube is being formed, charges of product are deposited on the filter paper at regular intervals in a longitudinal direction; each section of tube is then folded into a W shape at the center, between two consecutive charges, so as to form the so-called lobes of the bag, each containing a charge of product. Finally, the two lobes are pressed against one another, their open ends are sealed and, at the same time, a thread connecting them to a tag is attached to them at the sealed end. The tea bag made in this way can be picked up and handled by the thread, especially after it has been placed in boiling water, since one end of the thread is fixed to the bag and the other end to a tag which can be conveniently held between the fingers.

The sealing of the bag and the attachment of the thread can be effected in different ways.

In U.S. Pat. No. 2,307,998, which discloses a type of tea bag and the method for making it, the method which envisages knots to fix the thread to the bag and to the tag is attributed to prior art; in one of the examples in the drawings and in the description, the thread is secured to the tag and to the bag by a staple with the thread knotted to it, in another example, by a knot only.

According to the above-identified patent, knotting does not lend itself to high speed production; indeed, present-day industry has adopted stapling as the fastest and most effective way of securing tags to tea bags.

The disadvantage of this method, however, especially to secure the tag thread to the bag, is that the metal which the staples are made of may contaminate the infusion creating a disagreeable taste and even health problems.

Another method of securing the thread is described in U.S. Pat. No. 4,415,597, which discloses a filter-bag made of filter paper coated with a heat sealable layer of thermoplastic material, with a tag secured by a thread held at one end between two heat sealed edges of the bag, wound around the bag and detachably heat sealed to the outside of the bag itself at several points. Hence, the bag, or at least part of it, is made of paper and thermoplastic material.

This type of material has disadvantages similar to those mentioned above, since contact between the thermoplastic material and the infusion liquid at high temperatures can lead to contamination of the brew by substances in the thermoplastic material. Another disadvantage of the bag disclosed by this patent is the cost of the thermoplastic material, which is considerably higher than ordinary filter paper.

SUMMARY OF THE INVENTION

The object of the present invention is to eliminate the disadvantages mentioned above.

The invention, achieves this object by providing a method for securing a thread to a tea bag and to a tag by means only of knots and without using either metal staples or heat sealing processes.

BRIEF DESCRIPTION OF THE DRAWINGS

The advantages of the disclosure are apparent from the detailed description which follows, with reference to the accompanying drawings, which illustrate preferred embodiments of the invention by way of example and in which.

DESCRIPTION OF THE PREFERRED EMBODIMENTS

Figure 1:
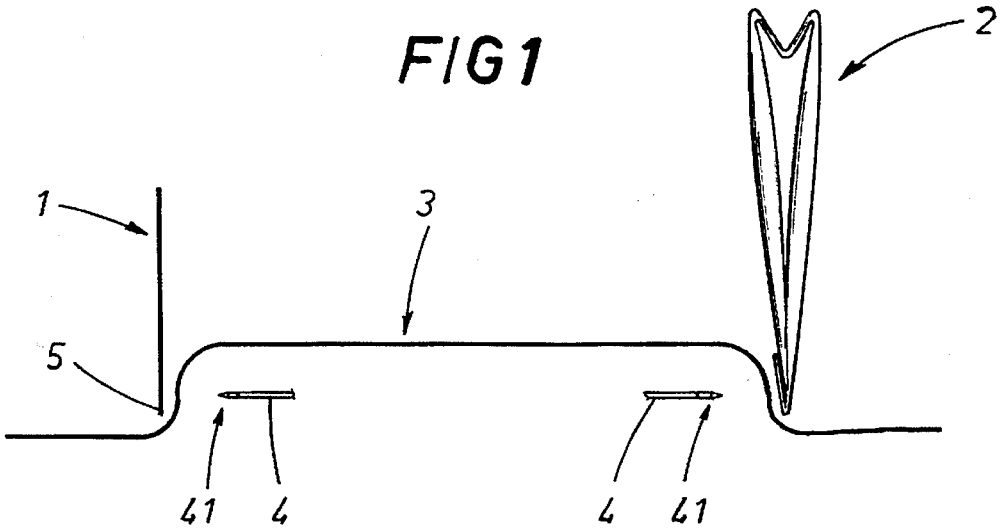
FIGS. 1, 2, 3, 4, 5 and 6 are schematic side views, with some parts cut away, showing a consecutive series of steps in a process embodying the method disclosed herein.

The method disclosed by the present invention will now be described with reference to the drawings listed above, which are not all drawn to the same scale, in order to better illustrate details of the invention. The method enables a tag 1 to be attached to a tea bag 2 using a length of thread 3 fixed to the tea bag at one end and to the tag 1 at the other.

The tea bag 2 and the tag 1 have at least one border 5 with reduced thickness to enable the thread 3 to be fixed to it.

The thread 3 may be attached to the tag 1 at the same time as it is attached to bag 2 or the two operations may be carried out in different stages, depending on the equipment used.

As shown especially in FIGS. 1 through 6 and 8 through 12, the method may include the stages described below.

The first stage (which may in some cases be unnecessary) consists in cutting the thread 3 to a length equal to the desired distance between tag and bag plus the length required to make at least two knots, the resulting length of thread 3 being positioned in such a manner that at least a section of it is opposite (parallel in the drawings) to the border 5 where it is to be fixed.

During the next stage, which is the first if the thread does not need to be cut, a first end or leader 31 of the thread 3 is hooked by the eye 41 of a needle 4.

Figure 8:
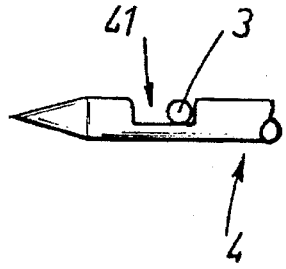
FIGS. 8, 9, 10, 11 and 12 are schematic side views, with some parts cut away, showing details of the possible parts and stages of the embodiment illustrated in the previous figures.
Figure 9:
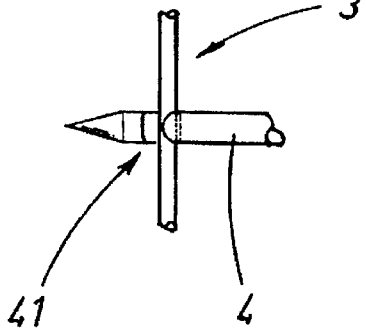
Figure 10:
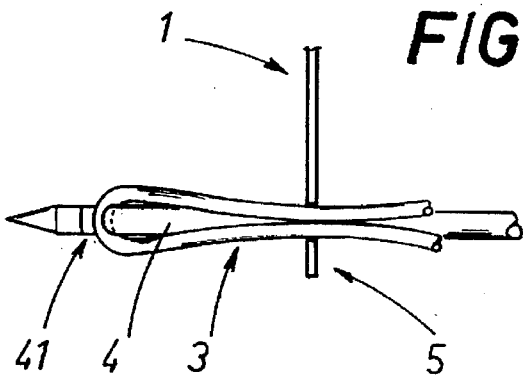

The eye may be of the open type, as illustrated in detail in FIG. 8.

Figure 2A:
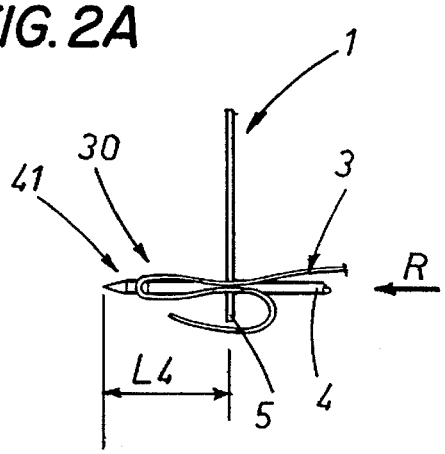
Figure 2B:
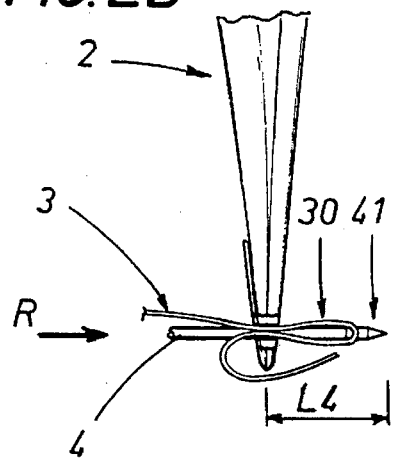
Figure 3A:
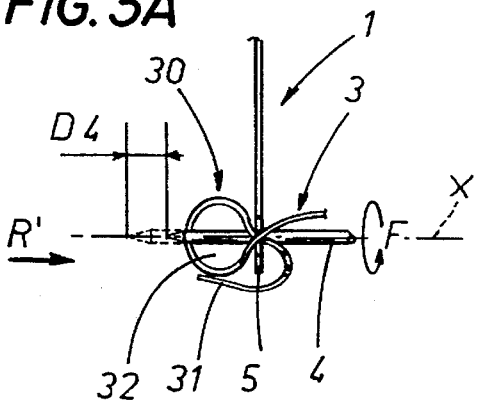
Figure 3B:
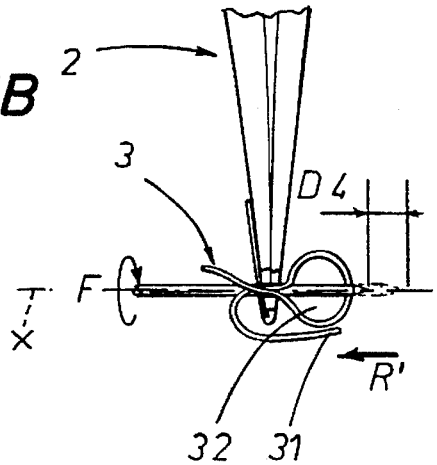

The needle is then run into the border 5 in a first direction R through to the opposite side of the border itself by a distance L4 sufficient to make a loop 30 in the thread 3, that is, to form a section where the thread is doubled up, as shown in FIG. 2. Next, only the needle 4 is partially withdrawn through the border 5 and twisted about its axis X in direction F through at least 180 degrees, leaving the doubled length of thread longer than the part of the needle that still protrudes so as to widen the loop 30 to form an aperture 32. In FIG. 3, the broken line shows the position of the needle 4 after its initial movement and D4 shows the position after the needle is partially withdrawn.

The rotational motion F of the needle 4 through at least 180 degrees twists the loop partially onto itself, allowing it to assume a configuration suitable for tying a knot.

Figure 4:
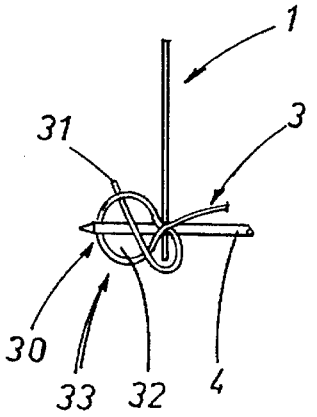
Figure 4:
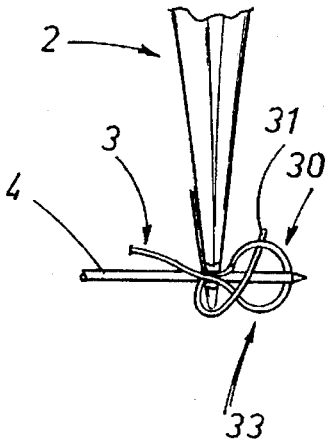
Figure 11:
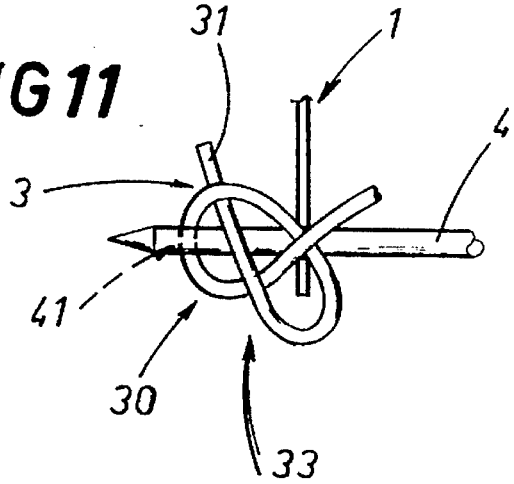
Figure 12:
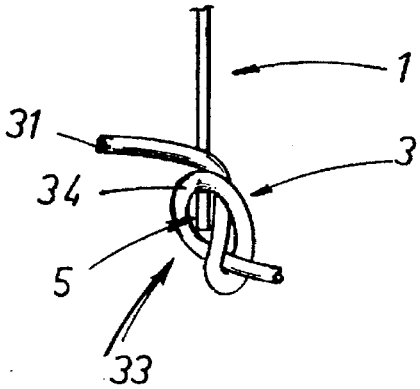
Figure 13:
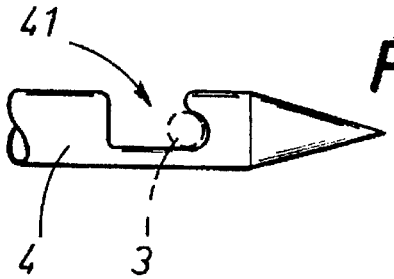
FIGS. 13, 14, 15, 16, 17 and 18 are schematic views, with some parts cut away, showing a consecutive series of steps in another process embodying the method disclosed herein.

The leader 31 is then inserted into the aperture 32 defined by the loop 30 and the needle 4 is pulled out to release the thread 3, the latter being subjected to a pulling action which tightens the resulting knot 33, as shown in FIGS. 4, 11 and 12.

In practice, when the thread 3 is pulled, the loop 30 passes almost entirely through the border 5 to the side from which the pulling action is exerted, while the leader 31 and a section of the thread 3 remain on the other side, the section of thread passing under, and tying, the border 5.

Figure 5:
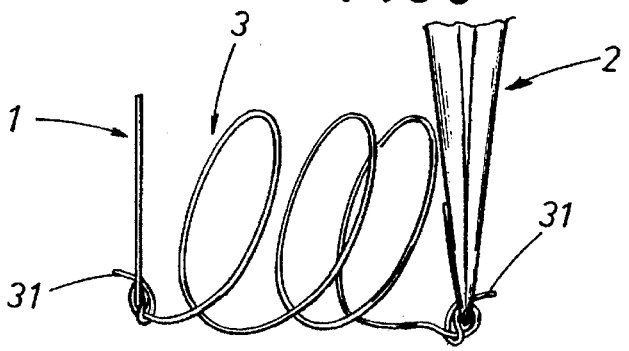
Figure 6:
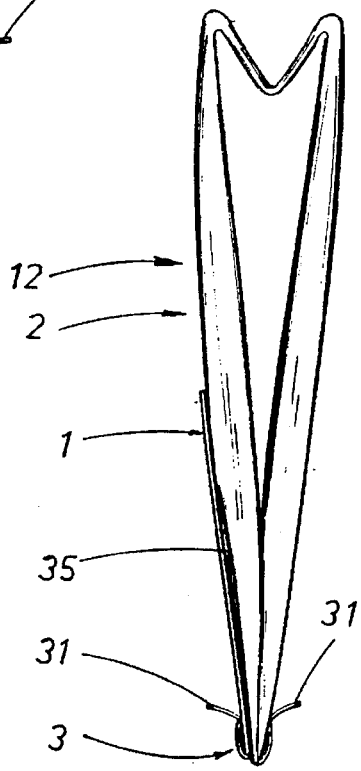
Figure 7:
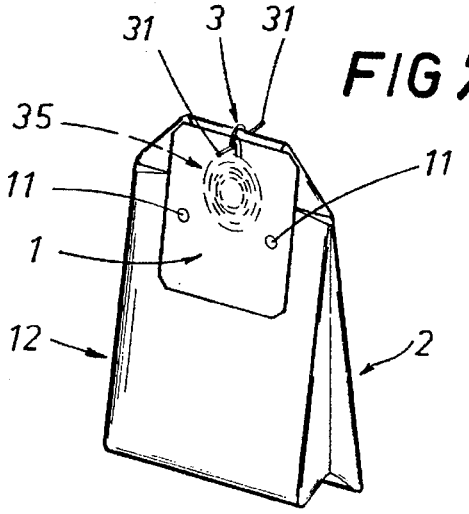
FIG. 7 is a top, perspective view of a tea bag made in accordance with the present invention.

Once the knot 33 has been tightened, two further stages illustrated in FIGS. 5 and 6 are possible to obtain an end product similar to that shown in FIG. 7.

In these two final stages (FIGS. 5 and 6), the section of the thread 3 between the tag 1 and the bag 2 is gathered up into a coil 35, for example by curling.

The tea bag 2 and the tag 1 are then pressed together, with the coil 35 of thread 3 between them.

The tag 1 may be made of paper coated with low temperature thermal adhesive and attached to the bag 2 by heat sealing at only two points 11, that is to say, in two areas of very limited extent.

The partial heat sealing of the tag 1 to the bag 2 forms a detachable seal between the tag 1, the coil 35, and the bag 2 so that the tag 1 can be easily pulled free of the bag 2, while the adhesive 11 remains on the tag 1.

During infusion, therefore, the adhesive does not come into contact with the boiling hot water used to make the brew.

As shown in FIGS. 13 through 18 (which, for convenience, illustrate only the attachment to the tag 1) the thread may be manipulated with a crochet needle, similar in many respects to a common crochet hook.

In this case, the stages embodying the method disclosed differ from those described above in the following aspects.

Figure 14:
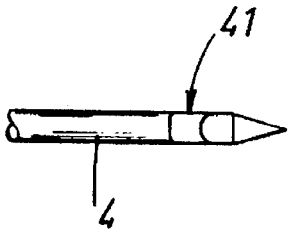
Figure 14:
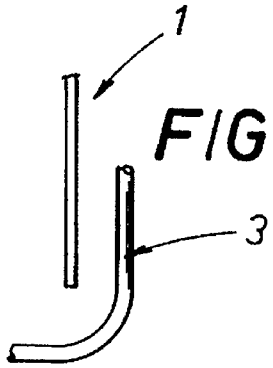
Figure 15:
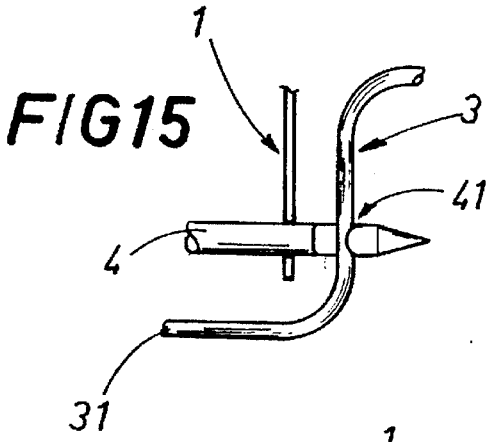
Figure 16:
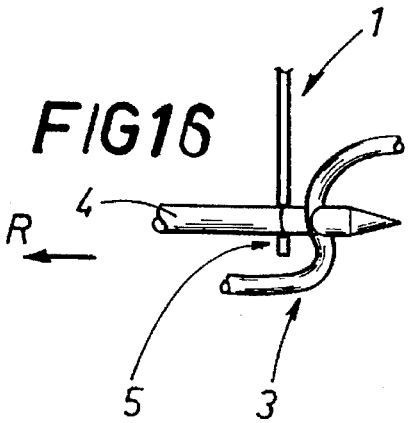
Figure 17:
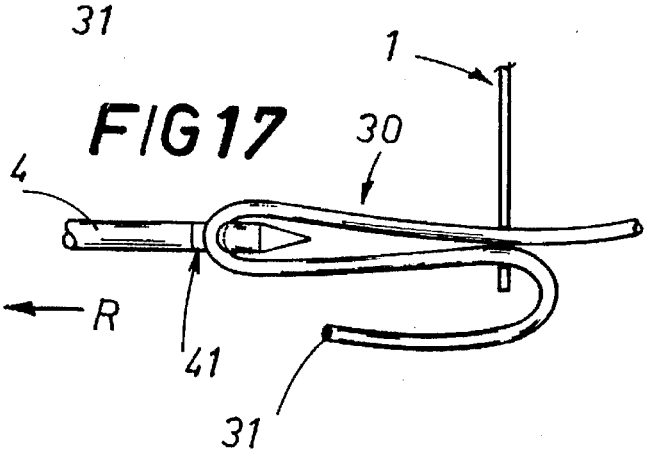

Initially, the part of the thread 3 to be hooked by the eye 41 of a crochet needle 4 is on the opposite side of the tag 1, as can be seen in FIG. 14.

Figure 18:
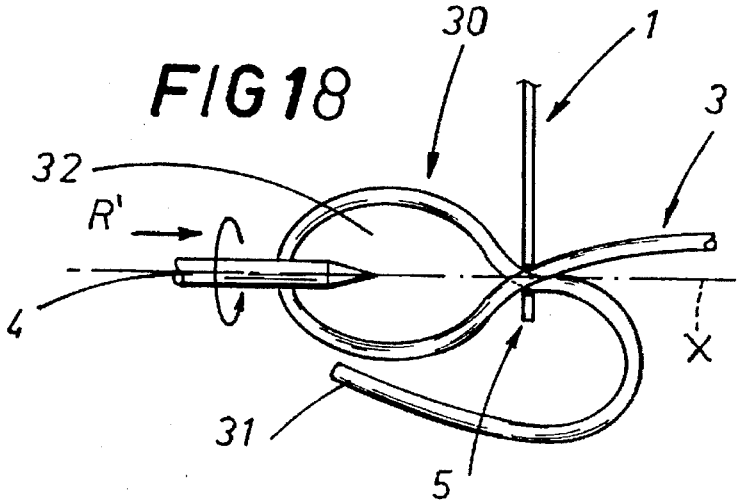

The needle 4 is then run through the border, hooks the thread 3 and pulls it back in a first direction R through the said border in a manner similar to that envisaged by the first embodiment, described above, and as illustrated in FIGS. 15, 16, and 17. In FIG. 18, the needle 4 is moved back partially in a direction R' opposite to the first direction R and then twisted about its axis X through at least 180 degrees, leaving a doubled up section of thread on the other side, longer than the part of the needle that still protrudes so as to widen the loop 30 to form an aperture 32.

Next, the leader 31 is threaded through the aperture 32 and the subsequent stages, such as the tightening of the knot 33, are the same as those envisaged by the first embodiment, described above. Yet another embodiment of the method disclosed is illustrated in FIGS. 19 through 23 and differs principally in the mode of defining the aperture 32.

In the embodiments described above, the aperture 32 is formed by partially withdrawing the needle 4. In the embodiment illustrated in FIGS. 19 through 23, however, the loop 30 is widened.

In practice, the needle 4 used for this embodiment has a first eye 41 near the point 40 and a second eye 42 further along it (on the left in the drawings).

Figure 19:
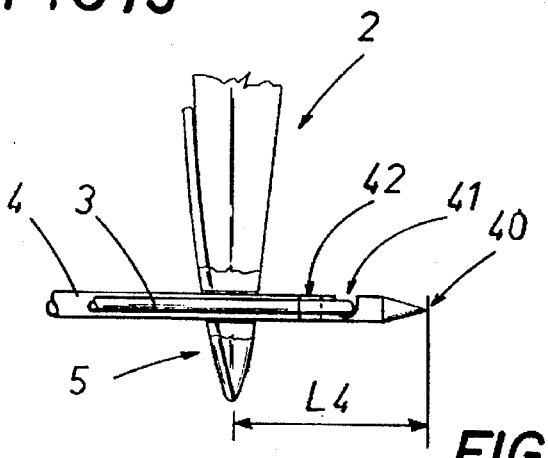
FIGS. 19, 20, 21, 22 and 23 are schematic views, with some parts cut away, showing a consecutive series of steps in yet another embodiment of the present invention.
Figure 20:
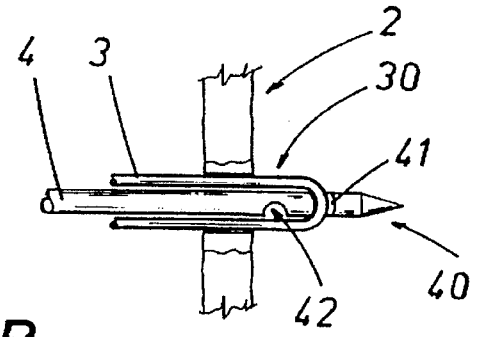
Figure 21A:
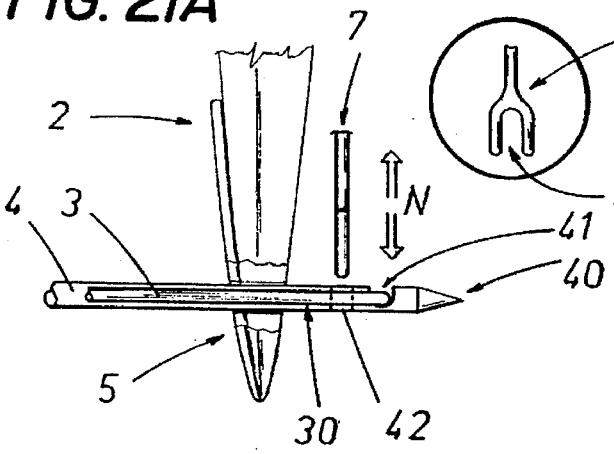
Figure 21B:
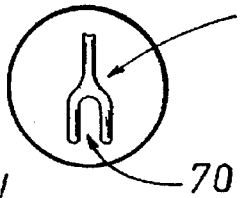
Figure 22:
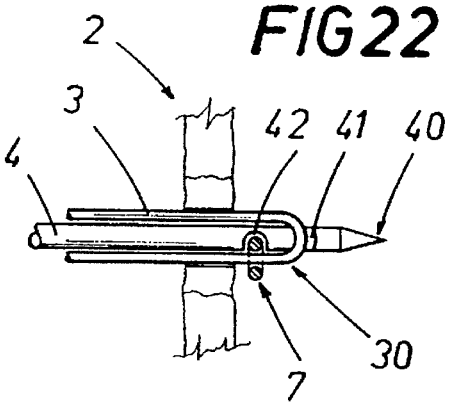
Figure 23:
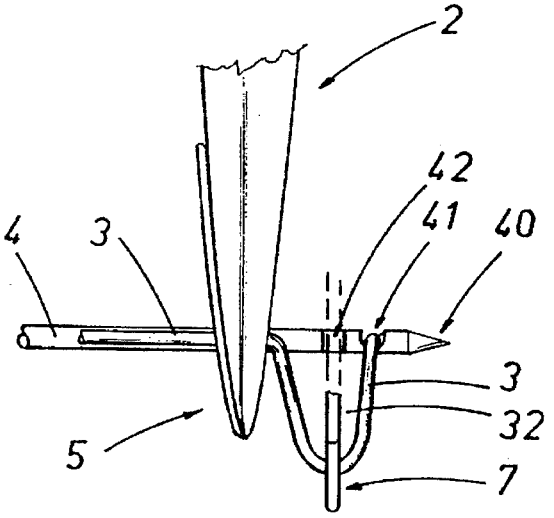

Once the needle 4 has been inserted into the border 5, which in the drawings being described is that of the bag 2, the configuration assumed by the needle and thread is that illustrated in FIGS. 19 and 20 in a side view and a top view, respectively. The needle 4 has been run through the border 5 by a distance L4 far enough for the eyes 41 and 42 to be both on the other side and to define the loop 30.

This embodiment envisages means 7 for hooking the thread 3, the means being represented in the drawings by a forked part. The means 7 move in a direction N (vertical in the drawings) which is substantially perpendicular to the direction in which the needle 4 passes through the border 5. As illustrated in detail in FIG. 21, the means 7 may consist of a fork shaped element with a hooking end 7 which passes through the second eye 42 when the hooking means 7 are in the active or hooking position.

Basically, the loop 30 is widened by its interaction with the hooking means 7, which pull more thread to the side of the border 5 (where the loop 30 is) in such a way as to form the aperture 32, also described in the other embodiments, through which the leader 31 is to be threaded.

The subsequent stages, that is, those in which the leader 31 is threaded through the aperture 32 and the resulting knot is tightened are the same as those envisaged by the embodiments illustrated in FIGS. 1 through 18.

The invention described can be subject to modifications and variations without thereby departing from the scope of the inventive concept. Moreover, all the details of the invention may be substituted by technically equivalent elements.

What is claimed is:

1. A method for attaching a tag to a tea bag using a two-ended piece of thread fixed to the tea bag at one end and to the tag at the other, the tea bag and the tag each having at least one thin border, comprising the steps of:

(a) hooking a first end or leader of said piece of thread by an eye of a needle and running said needle and said first end or leader of said piece of thread into one said border of a first one of said tag and said tea bag, in a first direction, through to the opposite side of said one border by an amount sufficient to make a loop in said piece of thread, thereby forming a section in which said piece of thread is doubled-up;

(b) widening said loop to form an aperture through which said first end or leader of said piece of thread can be inserted;

(c) inserting said first end or leader into said aperture and releasing said piece of thread from said eye of said needle, and pulling said piece of thread to tighten the resulting knot; and (d) attaching a second end of said piece of string to one said border of a second one of said tag and said tea bag.

2. The method for attaching a tag to a tea bag according to claim 1, comprising:

forming said aperture by partially withdrawing said needle in a direction opposite to said first direction and then twisting said needle about its own longitudinal axis through at least 180° degrees, leaving said doubled-up section of said piece of thread on a far side of said first one of said tag and said tea bag, longer than a remainder of the needle that remains protruding on a near side of said first one of said tag and said tea bag, so as to widen said loop to form said aperture.

3. A method for attaching a tag to a tea bag using a two-ended piece of thread fixed to the tea bag at one end and to the tag at the other, the tea bag and the tag each having at least one thin border, comprising the steps of:

(a) hooking a first end or leader of said piece of thread by a first eye of a needle which has a point, and which has a second eye in addition to said first eye, the second eye being located further along the longitudinal axis of said needle than said first eye, which is nearer to said needle point;

(b) running said needle and said first end or leader of said piece of thread into one said border of a first one of said tag and said tea bag, in a first direction, so that said first eye and said second eye penetrate through said one border by an amount sufficient to make a loop in said piece of thread, thereby forming a section in which said piece of thread is doubled-up and rests against said needle at said second eye;

(c) widening said loop by interacting said loop with a hook passing through said second eye in such a way as to form an aperture through which said first end or leader of said piece of thread can be inserted;

(d) inserting said first end or leader into said aperture and releasing said piece of thread from said first eye of said needle, and pulling said piece of thread to tighten the resulting knot; and (e) attaching a second end of said piece of string to one said border of a second one of said tag and said tea bag.

4. A method for attaching a tag to a tea bag using a two-ended piece of thread fixed to the tea bag at one end and to the tag at the other, the tea bag and the tag each having at least one thin border, comprising the steps of:

(a) hooking a first end or leader of said piece of thread by an eye of a needle and running said needle and said first end or leader of said piece of thread into one said border of a first one of said tag and said tea bag, from one side through to an opposite side of said one border, by an amount sufficient to make a loop in said piece of thread, thereby forming a section in which said piece of thread is doubled-up;

(b) partially withdrawing said needle through said one border and twisting said needle about its own longitudinal axis through at least 180° degrees, leaving a doubled-up section of said piece of thread on said opposite side, longer than a remainder of said needle that still protrudes from said one side, so as to widen said loop to form an aperture;

(c) inserting said leader into said aperture and extracting said needle from said one border so as to pull said piece of thread and thereby tighten the resulting knot; and (d) attaching a second end of said piece of string to one said border of a second one of said tag and said tea bag.

5. A method for attaching a tag to a tea bag using a two-ended piece of thread fixed to the tea bag at one end and to the tag at the other, the tea bag and the tag each having at least one thin border, comprising the steps of:

(a) hooking a first end or leader of said piece of thread by an eye of a crochet needle and running said needle and said first end or leader of said piece of thread into one said border of a first one of said tag and said tea bag, in a first direction, from one side and through to an opposite side of said one border by an amount sufficient to make a loop in said piece of thread, thereby forming a section in which said piece of thread is doubled-up;

(b) partially withdrawing said needle through said one border in a direction opposite to said first direction and then twisting said needle about its own longitudinal axis through at least 180° degrees, leaving a doubled-up section of thread on said opposite side, longer than a remainder of said needle that remains protruding, so as to widen said loop to form an aperture;

(c) inserting said first end or leader into said aperture releasing said needle from said piece of thread and pulling said piece of thread, thereby tightening the resulting knot; and (d) attaching a second end of said piece of string to one said border of a second one of said tag and said tea bag.

6. The method for attaching a tag to a tea bag according to claim 3, wherein:

in step (c), said loop is widened by moving said hook in a direction which is substantially perpendicular to said first direction and thereby passing a hooking element provided at an end of said hook, through said second eye.

7. The method for attaching a tag to a tea bag according to claim 1, further comprising:

before said hooking step, cutting a supply of thread to provide said piece of thread, having a length equal to a desired distance between the tag and the bag plus lengths required to make at least two knots, and positioning said length of thread in such a manner that at least a section thereof is parallel to said one border.

8. The method for attaching a tag to a tea bag according to claim 1, wherein:

at a same time that steps (a)–(c) are practiced, for fixing said first end or leader of said piece of thread to said tag, step (d) is practiced for fixing said second end said tea bag.

9. The method for attaching a tag to a tea bag according to claim 1 wherein:

step (d) is conducted after steps (a)–(c) have been conducted.

10. The method for attaching a tag to a tea bag according to claim 1, the tag being made of paper coated at least partially with a thermal adhesive, further comprising:

after said knot is tightened in step (d), gathering-up a portion of said piece of thread between said bag and said tag into a coil; and heat sealing said tag to said bag using a thermal adhesive, with said coil disposed between said tag and said bag, in such a way as to form a detachable seal between said tag, said coil and said bag so that said tag can be easily pulled free of said bag leaving said thermal adhesive adhered on said tag.

* * * * *